US006209556B1

(12) United States Patent
Yu

(10) Patent No.: US 6,209,556 B1
(45) Date of Patent: Apr. 3, 2001

(54) UMBRELLA SKELETON MADE OF COMPOSITE MATERIAL

(76) Inventor: Kuo-Pin Yu, No. 6, Lane 477, Sec. 2, Feng-Shyn Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/229,122

(22) Filed: Jan. 12, 1999

(51) Int. Cl.[7] ..... A45B 11/00

(52) U.S. Cl. ..... 135/15.1; 135/25.4; 135/98; 428/106

(58) Field of Search ..... 135/15.1, 16, 25.4, 135/25.41, 24, 97–99; 116/173, 174; 473/535, 561; 280/819, 821; 428/105–107, 203

(56) References Cited

U.S. PATENT DOCUMENTS 4,607,653 * 8/1986 Hermanson ..... 135/33.4 X
4,766,919 * 8/1988 Crates ..... 135/97
4,928,718 * 5/1990 Apple ..... 135/25.4 X
4,993,445 * 2/1991 Dubinsky ..... 135/25.4 X
5,020,557 * 6/1991 Apple ..... 135/15.1
5,167,274 * 12/1992 Belmonte ..... 135/16
5,217,221 * 6/1993 Baum ..... 273/67

* cited by examiner

*Primary Examiner*—Carl D. Friedman
*Assistant Examiner*—Winnie Yip
(74) *Attorney, Agent, or Firm*—Browdy and Neimark

(57) ABSTRACT

An umbrella skeleton is composed of a shaft, a runner fitted slidably over the shaft, a plurality of ribs arranged radially from the shaft such that ribs are fastened pivotally at one end thereof with the shaft, and a plurality of strut ribs fastened pivotally at one end thereof with the ribs and at other end thereof with the runner. The shaft is composed of a fiber-reinforced plastic core and a wooden sheath covering the core.

10 Claims, 2 Drawing Sheets

UMBRELLA SKELETON MADE OF COMPOSITE MATERIAL

FIELD OF THE INVENTION

The present invention relates generally to an umbrella skeleton, and more particularly to an umbrella skeleton which is made of a composite material.

BACKGROUND OF THE INVENTION

The conventional umbrella is generally composed of a shade of cloth, which is stretched over a foldable radial frame supported by a shaft of a metal material. The metal shaft is conductive to electricity and is thus prone to produce static electricity at the time when the umbrella is used in the rainy day. The user of the conventional umbrella is therefore vulnerable to electric shock. In addition, the metal shaft gives an added weight to the umbrella and rusts easily.

SUMMARY OF THE INVENTION

It is the primary objective of the present invention to provide an umbrella skeleton which is made of a composite material to prevent the user of the umbrella from being subjected to static electric shock.

It is another objective of the present invention to provide an umbrella skeleton which is made of a composite material and is relatively light in weight.

It is still another objective of the present invention to provide an umbrella skeleton which is made of a composite material to give a user thereof a better grip sense.

The objective, features and functions of the present invention will be readily understood upon a thoughtful deliberation of the following detailed description of the present invention with reference to the accompanying drawings.

DETAILED DESCRIPTION OF THE INVENTION

Figure 1:
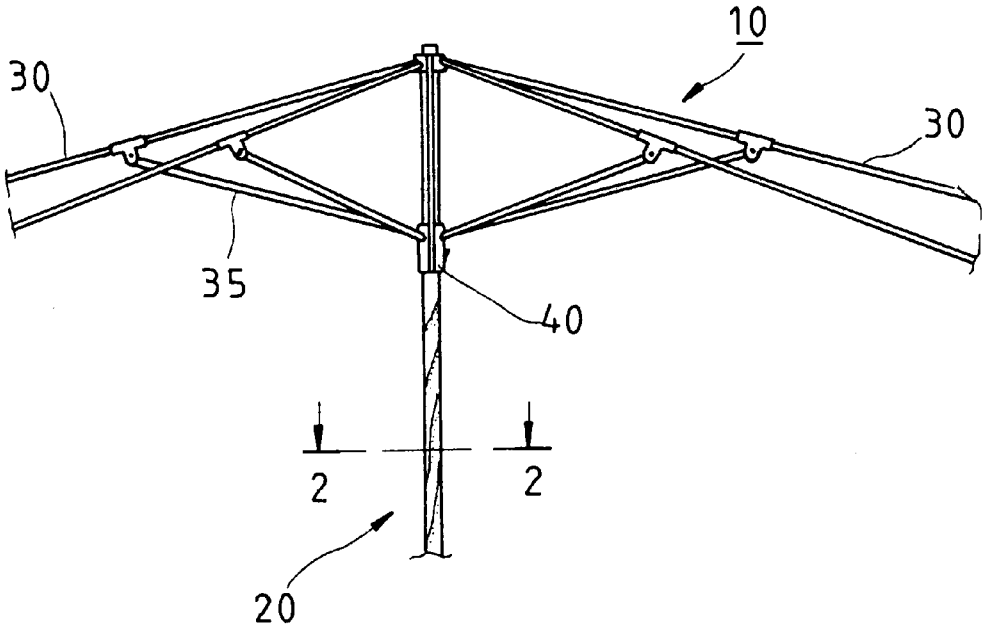
FIG. 1 shows a schematic view of a first preferred embodiment of the present invention.

As shown in FIG. 1, an umbrella skeleton 10 embodied in the present invention is composed of component parts which are described hereinafter.

A shaft 20 is of a slender and hollow construction.

A predetermined number of ribs 30 are arranged radially from the shaft 20 such that inner ends of the ribs 30 are fastened pivotally with the top of the shaft 20, and that the ribs 30 can swivel on the pivoting portion serving as a fulcrum.

A predetermined number of strut ribs 35 are equal in number to the ribs 30 and are fastened pivotally at one end thereof with the ribs 30 such that other end of the strut ribs 30 is fastened pivotally with a runner 40.

The runner 40 is slidably fitted over the shaft 20 such that the runner 40 can be displaced and located between an upper stop point and a lower stop point. The runner 40 can be displaced manually or automatically. The runner 40 is not the subject matter of the present invention.

Figure 2:
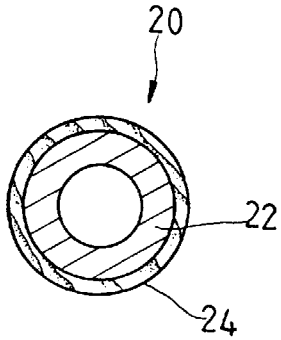
FIG. 2 shows a sectional view taken along the direction indicated by a line 2—2 as shown in FIG. 1.

The shaft 20 is composed of a fiber-reinforced plastic core 22 and a wooden sheath 24 covering the core 22, as shown in FIG. 2. The fiber-reinforced plastic core 22 is made of a plurality of carbon fiber fabric sheets which are preimpregnated with epoxy resin and wound together. The wooden sheath 24 is made of a thin wooden skin, a thin bamboo skin, or a wooden film.

Figure 3:
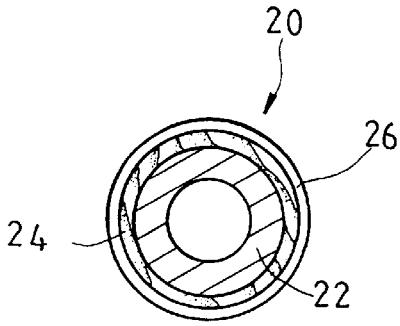
FIG. 3 shows a sectional view of a second preferred embodiment of the present invention.

As shown in FIG. 3, the shaft 20 is provided with a protective layer 26 covering the wooden sheath 24. The protective layer 26 is made of a thin transparent fiber cloth, such as a glass fiber cloth or a nonwoven cloth.

Figure 4:
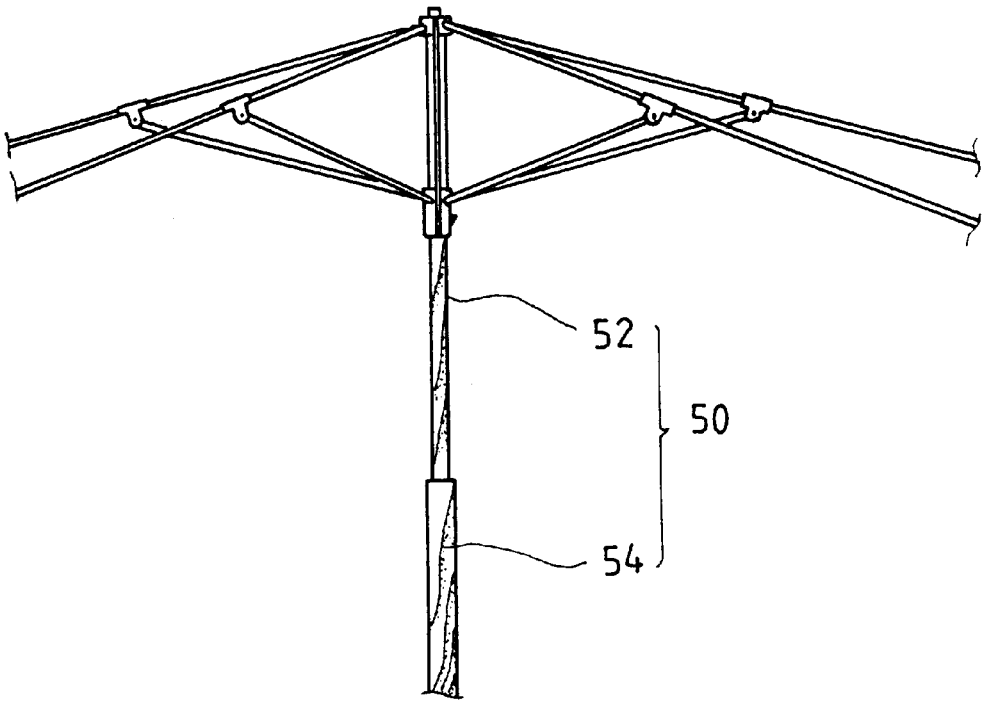
FIG. 4 shows a schematic view of a third preferred embodiment of the present invention.

As shown in FIG. 4, the second preferred embodiment of the present invention is different from the first preferred embodiment of the present invention in that the former has a segmented shaft 50 consisting of a first segment 52 and a second segment 54. The first segment 52 can be extracted from and retracted into the second segment 54.

Figure 5:
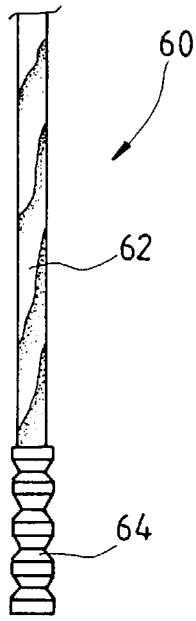
FIG. 5 shows a front schematic view of a shaft of a fourth preferred embodiment of the present invention.

As shown in FIG. 5, a shaft 60 of the third preferred embodiment of the present invention is composed of a core (not shown in the drawing), and a wooden sheath 62. The shaft 60 has a grip end 64 which is not covered by the wooden sheath 62.

Figure 6:
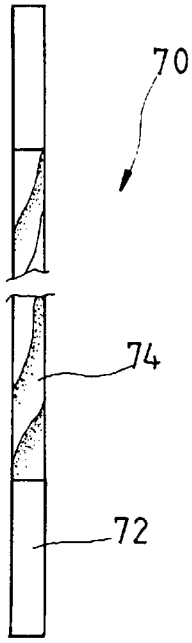
FIG. 6 shows a front schematic view of a shaft of a fifth preferred embodiment of the present invention.

As shown in FIG. 6, a shaft 70 of the fourth preferred embodiment of the present invention is composed of a core 72 having a midsegment which is covered with a wooden sheath 74. With the exception of the midsegment of the core 72, other portions of the core 72 are not covered with the wooden sheath 74.

Figure 7:
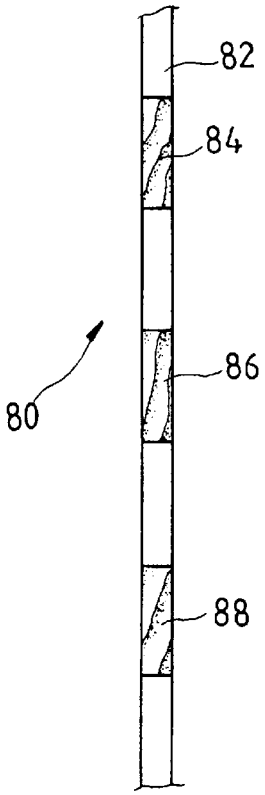
FIG. 7 shows a front schematic view of a shaft of a sixth preferred embodiment of the present invention.

As shown in FIG. 7, a shaft 80 of the fifth preferred embodiment of the present invention is composed of a fiber-reinforced plastic core 82 and a plurality of wooden sheath segments 84, 86, and 88, which are arranged at an interval.

All shafts embodied in the present invention may be provided with a protective layer covering the wooden sheath. The protective layer is made of a thin transparent fiber cloth, such as a glass fiber cloth or a nonwoven cloth.

The present invention has the advantages, which are described hereinafter.

The shaft of the umbrella skeleton of the present invention is provided in the outermost layer with a wooden sheath which is nonconductive to electricity to prevent the user of the umbrella from being subjected to electrical shock in the rainy weather.

The shaft of the umbrella skeleton of the present invention is made of materials resistant to rust and rust corrosion. In addition, the shaft of the present invention is made of the composite material and is therefore provided with a better structural strength. The wooden sheath of the shaft of the present invention gives an added esthetic effect to the shaft.

The shaft of the composite material is relatively lighter in weight to result in a reduction in overall weight of the umbrella.

What is claimed is:

1. An umbrella skeleton comprising:

a shaft;

a plurality of ribs arranged radially from said shaft such that said ribs are fastened pivotally at one end thereof with said shaft;

a runner slidably fitted over said shaft; and a plurality of strut ribs fastened pivotally at one end thereof with said ribs, and at other end thereof with said runner;

wherein said shaft consists of a fiber-reinforced plastic core, a thin non-load carrying wooden film covering said core and a protective layer covering said wooden film, said protective layer being made of a thin transparent fiber fabric made of glass fiber.

2. The umbrella skeleton as defined in claim 1, wherein said core is entirely covered by said wooden film.

3. The umbrella skeleton as defined in claim 1, wherein said core is partially covered by said wooden film.

4. The umbrella skeleton as defined in claim 3, wherein said core is covered by said wooden film, with the exception of a bottom end of said core.

5. The umbrella skeleton as defined in claim 1, wherein said wooden film is divided into a plurality of segments covering said core at an interval.

6. An umbrella skeleton comprising:

a shaft;

a plurality of ribs arranged radially from said shaft such that said ribs are fastened pivotally at one end thereof with said shaft;

a runner slidably fitted over said shaft; and a plurality of strut ribs fastened pivotally at one end thereof with said ribs, and at other end thereof with said runner;

wherein said shaft consists of a fiber-reinforced plastic core, a thin non-load carrying bamboo skin covering said core, and a protective layer covering said thin bamboo skin, said protective layer being made of a thin transparent fiber fabric made of glass fiber.

7. The umbrella skeleton as defined in claim 6, wherein said core is entirely covered by said bamboo skin.

8. The umbrella skeleton as defined in claim 6, wherein said core is partially covered by said bamboo skin.

9. The umbrella skeleton as defined in claim 8, wherein said core is covered by said bamboo skin, with the exception of a bottom end of said core.

10. The umbrella skeleton as defined in claim 6, wherein said bamboo skin is divided into a plurality of segments covering said core at an interval.

* * * * *